US005187528A

United States Patent [19]

Nishikawa et al.

[11] Patent Number: 5,187,528

[45] Date of Patent: Feb. 16, 1993

[54] ELECTROPHOTOGRAPHIC IMAGE FORMING APPARATUS HAVING CONTINUOUS FROM SKEW PREVENTION

[75] Inventors: Tomoyuki Nishikawa, Matsudo; Masahiro Kita, Tokyo, both of Japan

[73] Assignee: Asahi Kogaku Kogyo Kabushiki Kaisha, Tokyo, Japan

[21] Appl. No.: 683,546

[22] Filed: Apr. 10, 1991

[30] Foreign Application Priority Data

Apr. 13, 1990 [JP] Japan ..... 2-97880

[51] Int. Cl.[5] ..... G03G 15/00; G03G 15/20

[52] U.S. Cl. ..... 355/290; 355/309

[58] Field of Search ..... 355/200, 211, 282, 285, 355/289, 290, 309

[56] References Cited

U.S. PATENT DOCUMENTS 4,890,140 12/1989 Negoro ..... 355/290
4,928,141 5/1990 Poehlein et al. ..... 355/208
4,949,104 8/1990 Negoro et al. ..... 346/153.1

FOREIGN PATENT DOCUMENTS 63-116181 5/1988 Japan ..... 355/290
1-44474 2/1989 Japan ..... 355/290

*Primary Examiner*—Joan H. Pendegrass
*Attorney, Agent, or Firm*—Sandler, Greenblum & Bernstein

[57] ABSTRACT

An electrophotographic image forming apparatus is provided using a continuous form recording medium, in which the recording medium is nipped between a pair of fixing rollers, at-least-one of which is driven to rotate. The recording medium is fed in response to the rotation of the pair of fixing rollers. The peripheral speed of the at-least-one roller of the pair of fixing rollers is set to be faster than that of the photoconductive drum by a predetermined ratio so that slack of the recording medium between the photoconductive drum and the fixing rollers may be eliminated. Thus, the recording medium is fed properly without the occurrence of skewing between the photoconductive drum and the fixing rollers.

6 Claims, 2 Drawing Sheets

ELECTROPHOTOGRAPHIC IMAGE FORMING APPARATUS HAVING CONTINUOUS FROM SKEW PREVENTION

BACKGROUND OF THE INVENTION

The present invention relates to an electrophotographic image forming apparatus using a continuous form recording medium.

Conventionally, there is known an electrophotographic image forming apparatus, such as a copy machine or printer that employs an electrophotographic image forming process. In the electrophotographic image formation apparatus, the uniformly charged photoconductive material provided on the surface of a photoconductive drum is exposed to light that carries image data to form a latent image. The latent image is developed by adhering toner thereto (a toner image is formed), and the toner image is transferred onto a recording medium and fixed.

Some of the electrophotographic printers print images onto a so-called fanfold recording sheet which is a continuous recording sheet provided with perforated tear lines, which are defined at the portions to be folded (hereinafter, this continuous form recording sheet is simply abbreviated as a continuous sheet). The continuous sheet can be easily cut off at the perforated tear lines.

Incidentally, in the electrophotographic image forming apparatus, a so-called heat roll fixing is generally employed.

In the heat roll fixing, a pair of fixing rollers comprising a heat roller heated to a high temperature and a press roller are arranged in parallel. The recording sheet, carrying an unfixed toner image thereon, is positioned between the pair of fixing rollers. The unfixed toner image on the recording sheet is fused by being heated with a heated roller (heat roller) and fixed onto the recording sheet at a fixing unit. The heat roll fixing is advantageous in that an excellent energy efficiency is realized and a fixing speed can be increased.

The fixing unit also functions as a feed mechanism to feed the recording sheet that is positioned between the pair of fixing rollers. Usually, the heat roller is rotatably driven, and the press roller is rotated in accordance with the heat roller. In this case, the feed speed of the continuous sheet by the heat roll fixing unit (e.g., the peripheral speed of the heat roller) is set to equal the peripheral speed of a photoconductive drum with high accuracy.

In the electrophotographic printer as above, wherein images are printed onto a continuous sheet, and the continuous sheet is fed by the heat roll fixing unit, a problem arises in that so-called skewing occurs (e.g., the continuous sheet proceeds obliquely or windingly) when the photoconductive drum is not accurately disposed in parallel with the heat roller, or there is a difference in the contact pressure between the heat roller and the press roller in the width direction of the continuous sheet. It is very difficult to eliminate these skew factors by improving a mechanical accuracy.

Once skewing arises, the position where the fixing unit (fixing roller pair) takes in the continuous sheet is moved to an oblique direction as the continuous sheet is fed. Finally, a jam occurs.

The skewing occurs with a relatively low frequency at a high printing ratio wherein the photoconductive material has a low potential because the larger area thereof is exposed to light, and further the continuous sheet is in less intimate contact with the photoconductive material (photoconductive drum) because toner exists therebetween.

On the other hand, in a low printing ratio, skewing tends to occur because the continuous sheet is in intimate contact with the photoconductive drum, and the photoconductive drum strongly affects the feed of the continuous sheet. If a proceeding direction of the continuous sheet is slightly displaced from its normal feeding direction, the more the photoconductive drum affects the feeding of the continuous sheet, the more the deflection of the continuous sheet is accumulated to cause skewing.

SUMMARY OF THE INVENTION

It is therefore an object of the present invention to provide an improved electrophotographic printer that is capable of preventing skewing with a simple arrangement.

For the above object, according to the present invention, there is provided an electrophotographic image forming apparatus using a continuous form recording medium, comprising a photoconductive drum that is driven to rotate a pair of fixing rollers, at-least-one of the pair of fixing rollers being driven to rotate with a nipping of the recording medium therebetween, whereby the recording medium being fed in response to a rotation of the at-least-one of the pair of fixing rollers, wherein a peripheral speed of the at-least-one of the fixing rollers is faster than a peripheral speed of the photoconductive drum by a predetermined ratio.

Further, the electrophotographic image forming apparatus comprises a single driving source for supplying a driving force, and means for transmitting the driving force supplied by the single driving means to both the photoconductive drum and the at-least-one of the pair of fixing rollers.

Optionally, the peripheral speed of the photoconductive drum is in the range of 99.6 percent to 99.8 percent of the peripheral speed of the at-least-one of the pair of fixing roller. In another embodiment of the present invention, a method for preventing the skewing of a continuous form recording medium is provided for an electrophotographic image forming apparatus including a rotatable photoconductive drum for transferring an image onto the recording medium, and a pair of rotatable fixing rollers for fixing the image onto the recording medium. The skew preventing method comprises the steps of feeding recording medium to a photoconductive drum, setting a peripheral speed of the photoconductive drum, nipping the recording medium between a pair of fixing rollers, and setting a peripheral speed of at-least-one of the fixing rollers to be faster than a peripheral speed of the photoconductive drum to prevent slack of the recording medium between the photoconductive drum and the pair of fixing rollers.

DESCRIPTION OF THE ACCOMPANYING DRAWINGS

DESCRIPTION OF THE EMBODIMENTS

Figure 1:
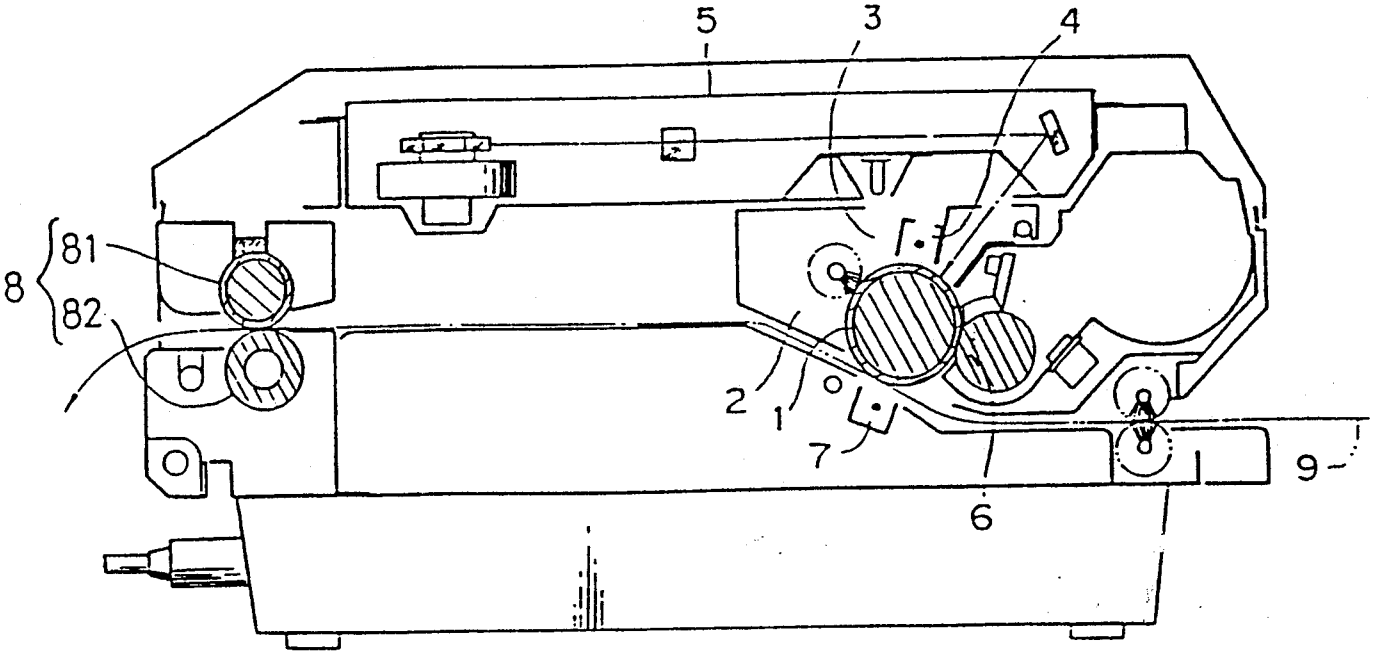
FIG. 1 is a schematic side view of a laser beam printer embodying the present invention.

FIG. 1 is a schematic side view of a laser beam printer embodying the present invention.

The laser beam printer comprises a toner cleaning station 2, a discharging station 3, a charging station 4, a scanning optical system 5 for emitting a scanning laser beam onto a photoconductive drum 1, a developing station 6, a transferring station 7 around the circumference of the photoconductive drum 1 along the rotational direction thereof, and a fixing station 8 that is disposed at a left hand side of the printer in FIG. 1. In this laser beam printer, a continuous sheet 9 is fed from right to left, as shown in FIG. 1.

A main scanning is executed such that the charged surface of the photoconductive drum 1 is exposed to the scanning laser beam emitted from the scanning optical system 5 in the axial direction of the photoconductive drum 1. The the photoconductive drum 1 is rotated and an auxiliary scanning is executed, so that a latent image is formed on the surface of the photoconductive drum 1. The latent image is developed by sticking a toner thereon at the developing station 6 so as to form a toner image, the toner image being transferred onto the continuous sheet 9 at the transferring station 7. The toner image is fixed on the continuous sheet 9 at the fixing station 8, and discharged from the printer.

The fixing station 8 comprises a heat roller 81 that is disposed on the upper side of a continuous sheet feed path and a press roller 82 that is urged to be pressed against the heat roller 81 from a lower side of the sheet feed path. The continuous sheet is held between the heat roller 81 and the press roller 82 and heated/pressed so that the toner image is fixed.

The photoconductive drum 1 and the heat roller 81 of the fixing station 8 are driven to be rotated by the same drive source (see FIGS. 2 and 3), and thus, the rotations thereof (e.g., the photoconductive drum 1 and heat roller 81) correspond to each other. The continuous sheet 9 that is nipped positioned between the heat roller 81 and the press roller 82 is driven to be fed by the heat roller 81.

In the laser beam printer embodying the present invention, the peripheral speed of the photoconductive drum 1 is set to be slightly slower than that of the heat roller 81. In other words, the peripheral speed of the heat roller 81 is slightly faster than that of the photoconductive drum 1.

With the above arrangement slack of to the continuous sheet 9 between the photoconductive drum 1 and the fixing station 8 due to the difference of the peripheral speed therebetween is eliminated. Thus the continuous sheet 9 is fed properly and the occurrence of skewing is prevented.

In principle, the difference between the peripheral speeds of the photoconductive drum 1 and the heat roller 81 is preferably set in such a manner that slack of the continuous sheet 9 between the photoconductive drum 1 and the heat roller 81 is prevented, even if the machining tolerances of the photoconductive drum 1 and the heat roller 81 are combined, and that the change of the feed speed of continuous sheet 9 at the fixing station 8 due to a slip between toner on the continuous sheet 9 and the heat roller 81 can be absorbed. Further, since the difference between the speeds of the photoconductive drum 1 and the heat roller 81 is absorbed by the slip caused between the continuous sheet 9 and any one of the photoconductive drum 1 and the heat roller 81, the difference should be limited to a range by which a noticeable shear of an image is not produced by the slip.

Table 1 shows the result of an experiment in which thin lines were printed with various speed differences between the photoconductive drum 1 and the heat roller 81 using an actual apparatus.

TABLE 1

| Peripheral Speed of Photoconductive Drum with Respect to That of Heat Roller | Line width |
|---|---|
| 0% | 240 μm |
| −0.3% | 240 μm |
| −1.05% | 270 μm |
| −1.80% | 290 μm |

The experiment shows that the width of the printed line when the peripheral speed of the photoconductive drum 1 is −0.3% with respect to that of the heat roller 81 is substantially similar to the line width when the peripheral speed of the photoconductive drum 1 is equal to that of the heat roller 81. Practically, the shear of the image caused by the speed difference between the photoconductive drum 1 and the heat roller 81 becomes different depending upon the width of the continuous sheet 9 attracted to the photoconductive drum 1. Accordingly, the peripheral speed of the photoconductive drum 1 is set to be in a range of 98.6 percent to 99.8 percent of that of the heat roller 81 in actual use.

Figure 2:
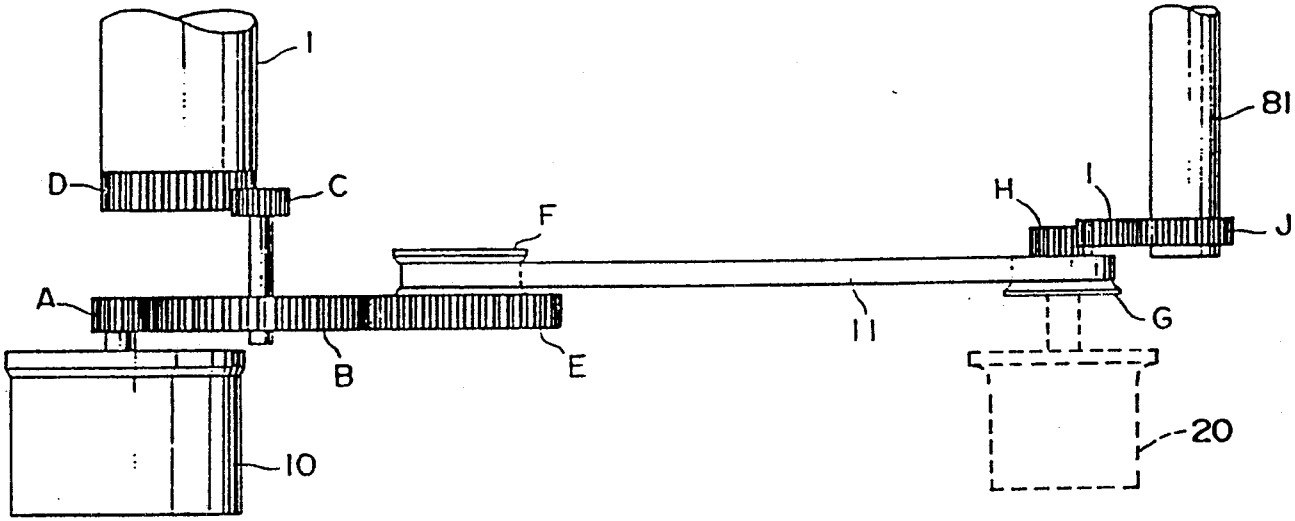
FIG. 2 is a plan view of the mechanism for driving the photoconductive drum and the heat roller.
Figure 3:
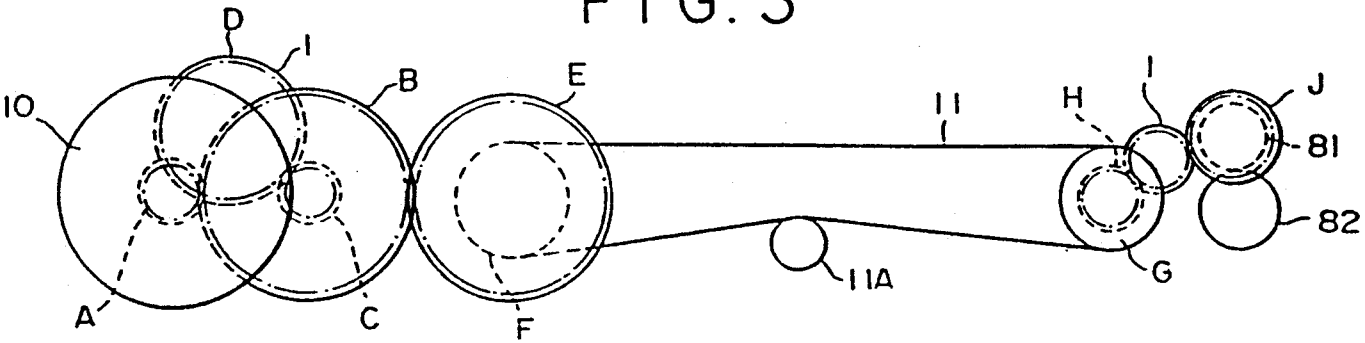
FIG. 3 is a side view of the mechanism of FIG. 2.

FIGS. 2 and 3 show a plan view and a side view, respectively of a mechanism for driving the photoconductive drum 1 and the heat roller 81 with a single motor 10. A driving force of a motor 10 is transmitted to the photoconductive drum 1 through gears A, B, C and D, while the driving force of the motor 10 is transmitted to the heat roller 81 through gears A, B, E, a pulley F, a belt 11, a pulley G, gears H, I, J. Note that an outer diameter of gear D is equal to that of the photoconductive drum 1, and a pulley 11A is provided so as to apply a predetermined tension to the belt 11. Table 2 shows the number of the teeth of each gear. Peripheral speeds of the photoconductive drum 1, and the heat roller 81 are also shown in Table 2. According to Table 2, the peripheral speed of gear D, i.e., the peripheral speed of the photoconductive drum 1, is 0.256 percent less than that of the heat roller 81.

TABLE 2

| | number of teeth | rotation speed (rpm) | outer diameter (mm) | peripheral speed (mm/sec) |
|---|---|---|---|---|
| motor 10 | | 300 | | |
| gear A | 16 | 300 | | |
| gear B | 51 | 94.118 | | |
| gear C | 17 | 94.118 | | |
| gear D | 45 | 35.556 | 40.00 | 74.468 |
| (drum 1) | | (35.556) | (40.00) | (74.468) |
| gear E | 50 | 96 | | |
| pulley F | 20 | 96 | | |
| pulley G | 26 | 73.846 | | |
| gear H | 27 | 73.846 | | |
| gear I | 25 | 79.754 | | |
| gear J | 35 | 56.967 | | |
| heat roll | | 56.967 | 25.03 | 74.659 |

Note, in the above embodiment, although the photoconductive drum 1 and the heat roller 81 are arranged to be driven to be rotated by the same drive source, the present invention is not limited to this arrangement and may be of course arranged to be driven by independent drive sources, respectively, and subject to be independently controlled. For example, as shown in FIG. 2, the drum 1 and heat roller 81 can be driven independently by motor 10 and motor 20 (shown in dotted lines), respectively, eliminating the need for pulley F, belt 11, and pulley G.

As described above, according to the electrophotographic printer embodying the present invention, slack of the continuous sheet between the photoconductive drum and the heat roll fixing station can be prevented and skewing caused thereby can also be prevented with a very simple arrangement in which the peripheral speed of the photoconductive drum is set to be slower than that of the heat roller by a predetermined ratio.

The present disclosure relates to a subject matter contained in Japanese patent application No. HEI 2-97880 (filed on Apr. 13, 1990) which is expressly incorporated herein by reference in its entirety.

What is claimed is:

1. An electrophotographic image forming apparatus using a continuous form recording medium, comprising:

a photoconductive drum that is driven to rotate; and a pair of fixing rollers, at-least-one roller of said pair of fixing rollers being driven to rotate with said recording medium positioned therebetween, whereby said recording medium is fed in response to a rotation of said at-least-one roller of said pair of fixing rollers, wherein a peripheral speed of said at-least-one roller of said pair of fixing rollers is faster than a peripheral speed of said photoconductive drum by a predetermined ratio, whereby slack of said recording medium between said photoconductive drum and said fixing rollers is prevented.

2. The electrophotographic image forming apparatus according to claim 1, further comprising:

a single driving source for supplying a driving force; and means for transmitting said driving force to both said photoconductive drum and said at-least-one roller of said pair of fixing rollers.

3. The electrophotographic image forming apparatus according to claim 1, wherein said peripheral speed of said photoconductive drum is approximately in a range of 99.6 percent to 99.8 percent of said peripheral speed of said at-least-one roller of said pair of fixing rollers.

4. The electrophotographic image forming apparatus according to claim 1, further comprising independent drive sources for supplying a driving force to said photoconductive drum and to said at-least-one roller of said pair of fixing rollers, respectively.

5. A method for preventing the skewing of a continuous form recording medium in an electrophotographic image forming apparatus, comprising a rotatable photoconductive drum for transferring an image onto the recording medium, and a pair of rotatable fixing rollers for fixing the image onto the recording medium, comprising the steps of:

(1) feeding the recording medium to the photoconductive drum;

(2) setting a peripheral speed of the photoconductive drum;

(3) nipping the recording medium between the pair of fixing rollers; and (4) setting a peripheral speed of at-least-one of the fixing rollers to be faster than the peripheral speed of the photoconductive drum to prevent slack of the recording medium between the photoconductive drum and the pair of fixing rollers.

6. The method according to claim 5, further comprising the step of setting the peripheral speed of the photoconductive drum approximately within the range of 99.6% to 99.8% of the peripheral speed of at-least-one roller of the fixing rollers.

* * * * *

UNITED STATES PATENT AND TRADEMARK OFFICE

CERTIFICATE OF CORRECTION

PATENT NO. : 5,187,528
DATED : February 16, 1993
INVENTOR(S) : T. Nishikawa et al.

It is certified that error appears in the above-indentified patent and that said Letters Patent is hereby corrected as shown below:

On the title page, item [54] and col. 1, line 2, change "FROM" to --FORM--.

Signed and Sealed this

Twenty-sixth Day of March, 1996

Bruce Lehman

*Attest:*

BRUCE LEHMAN

*Attesting Officer*

*Commissioner of Patents and Trademarks*